US008353669B2

(12) United States Patent
Chon et al.

(10) Patent No.: US 8,353,669 B2
(45) Date of Patent: Jan. 15, 2013

(54) TURBINE VANE PLATFORM LEADING EDGE COOLING HOLES

(75) Inventors: Young H. Chon, West Hartford, CT (US); Dominic J. Mongillo, West Hartford, CT (US); Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 885 days.

(21) Appl. No.: 12/542,918

(22) Filed: Aug. 18, 2009

(65) Prior Publication Data

US 2011/0044795 A1 Feb. 24, 2011

(51) Int. Cl.
*F01D 5/08* (2006.01)

(52) U.S. Cl. ..... 416/96 R; 416/193 A

(58) Field of Classification Search ..... 415/115; 416/96 R, 97 R, 193 A
See application file for complete search history.

(56) References Cited

U.S. PATENT DOCUMENTS

| | | | | |
|---|---|---|---|---|
| 3,936,215 | A | 2/1976 | Hoff | |
| 4,177,011 | A * | 12/1979 | Eskesen et al. | 416/191 |
| 4,288,201 | A | 9/1981 | Wilson | |
| 4,767,260 | A | 8/1988 | Clevenger et al. | |
| 4,821,522 | A | 4/1989 | Matthews et al. | |
| 5,096,379 | A * | 3/1992 | Stroud et al. | 416/97 R |
| 5,217,348 | A | 6/1993 | Rup, Jr. et al. | |
| 5,344,283 | A | 9/1994 | Magowan et al. | |
| 5,413,458 | A | 5/1995 | Calderbank | |
| 5,741,117 | A | 4/1998 | Clevenger et al. | |
| 5,931,638 | A | 8/1999 | Krause et al. | |
| 6,179,565 | B1 | 1/2001 | Palumbo et al. | |
| 6,234,754 | B1 * | 5/2001 | Zelesky et al. | 416/97 R |
| 6,254,333 | B1 * | 7/2001 | Merry | 415/115 |
| 6,572,335 | B2 * | 6/2003 | Kuwabara et al. | 416/97 R |
| 6,599,092 | B1 * | 7/2003 | Manning et al. | 416/97 R |
| 6,607,355 | B2 | 8/2003 | Cunha et al. | |
| 6,722,138 | B2 | 4/2004 | Soechting et al. | |
| 6,761,529 | B2 * | 7/2004 | Soechting et al. | 415/115 |
| 6,923,247 | B1 * | 8/2005 | Ferber et al. | 165/47 |
| 6,939,107 | B2 | 9/2005 | Mongillo, Jr. et al. | |
| 7,018,176 | B2 | 3/2006 | Mongillo et al. | |
| 7,021,893 | B2 | 4/2006 | Mongillo, Jr. et al. | |
| 7,059,825 | B2 | 6/2006 | Magowan et al. | |
| 7,080,623 | B1 | 7/2006 | Badgley | |
| 7,131,818 | B2 | 11/2006 | Cunha et al. | |
| 7,186,082 | B2 | 3/2007 | Mongillo, Jr. et al. | |
| 7,377,748 | B2 | 5/2008 | Mongillo, Jr. et al. | |
| 7,452,186 | B2 | 11/2008 | Charbonneau et al. | |
| 7,467,924 | B2 | 12/2008 | Charbonneau et al. | |
| 7,478,994 | B2 | 1/2009 | Cunha et al. | |
| 7,625,172 | B2 * | 12/2009 | Walz et al. | 415/115 |
| 8,096,772 | B2 * | 1/2012 | Liang | 416/97 R |
| 2008/0095635 | A1 | 4/2008 | Chon | |
| 2008/0099178 | A1 | 5/2008 | Propheter-Hinckley et al. | |
| 2008/0170944 | A1 | 7/2008 | Propheter-Hinckley | |
| 2008/0199317 | A1 | 8/2008 | Spangler et al. | |
| 2009/0047136 | A1 | 2/2009 | Chon et al. | |
| 2009/0074575 | A1 | 3/2009 | Propheter-Hinckley et al. | |

* cited by examiner

*Primary Examiner* — Edward Look
*Assistant Examiner* — Liam McDowell
(74) *Attorney, Agent, or Firm* — Carlson, Gaskey & Olds, PC

(57) ABSTRACT

A vane for use in a gas turbine engine has a platform connected to an airfoil. There is a cooling passage for supplying cooling air to the platform. A cooling chamber supplies cooling air to a plurality of cooling slots at the platform. The cooling slots have a non-uniform cross section.

16 Claims, 3 Drawing Sheets

TURBINE VANE PLATFORM LEADING EDGE COOLING HOLES

BACKGROUND OF THE INVENTION

This application was made with government support under Contract No. N00019-02-C-3003 awarded by the United States Navy. The Government may therefore have certain rights in this invention.

This application relates to turbine vane cooling.

Gas turbine engines typically include a compression section which compresses air. The compressed air is mixed with fuel and combusted in a combustion section. Products of that combustion pass downstream over turbine rotors, which are driven to rotate. The turbine rotors carry blades, and typically have several stages. Stationary vanes are positioned intermediate the stages. The stationary vanes are subject to extremely high temperatures from the products of combustion. Thus, cooling schemes are utilized to provide cooling air to the vanes.

A vane typically includes an airfoil and intermediate platforms at each end of the airfoil. It is known to provide platform cooling holes. In general, the vanes have been cast as a thin wall generally hollow item at their platform, and cooling holes have been drilled through the thin wall.

While the cooling holes provide some modest level of film cooling to the vane platforms, as temperatures of combustion increase, it would be desirable to provide both a more uniform and increased level of cooling effectiveness along the platform surface.

It becomes desirable to incorporate a cooling scheme that provides both active backside convective cooling along with more effective gas path film cooling.

It is known to provide a teardrop shaped cooling feature at the trailing edge of the airfoil. A teardrop shape cooling feature has a shape defined by flow dividers with a shape that is generally similar to a teardrop, and results in certain flow characteristics. However these features have not been used to facilitate film cooling along other high heat load regions of the airfoil and platform surfaces.

SUMMARY OF THE INVENTION

A vane for use in a gas turbine engine has a platform connected to an airfoil. There is a cooling passage for supplying cooling air to the platform. The platform has a leading edge and a trailing edge. A cooling chamber supplies cooling air to a plurality of cooling slots on the platform. The slots have a non-uniform cross section.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
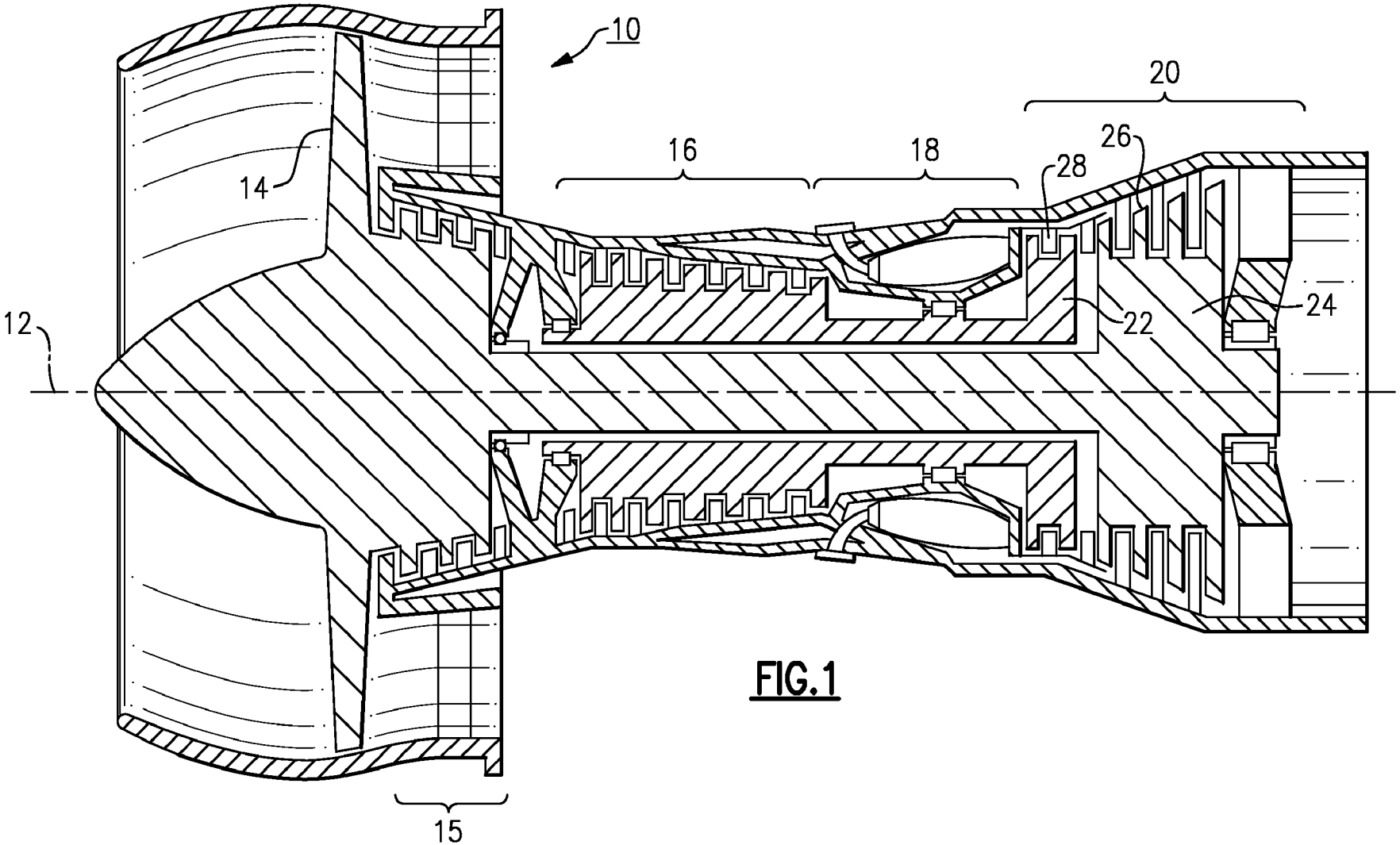
FIG. 1 shows a schematic of a turbine engine.

A gas turbine engine 10, such as a turbofan gas turbine engine, circumferentially disposed about an engine centerline, or axial centerline axis 12 is shown in FIG. 1. The engine 10 includes a fan 14, compressor sections 15 and 16, a combustion section 18 and a turbine section 20. As is well known in the art, air compressed in the compressor 15/16 is mixed with fuel and burned in the combustion section 18 and expanded across turbine 20. The turbine section 20 includes rotors 22 (high pressure) and 24 (lower pressure), which rotate in response to the expansion. The turbine section 20 comprises alternating rows of rotary airfoils or blades 26 and static airfoils or vanes 28. In fact, this view is quite schematic, and blades 26 and vanes 28 are actually removable. It should be understood that this view is included simply to provide a basic understanding of the sections in a gas turbine engine, and not to limit the invention. This invention extends to all types of turbine engines for all types of applications.

Figure 2:
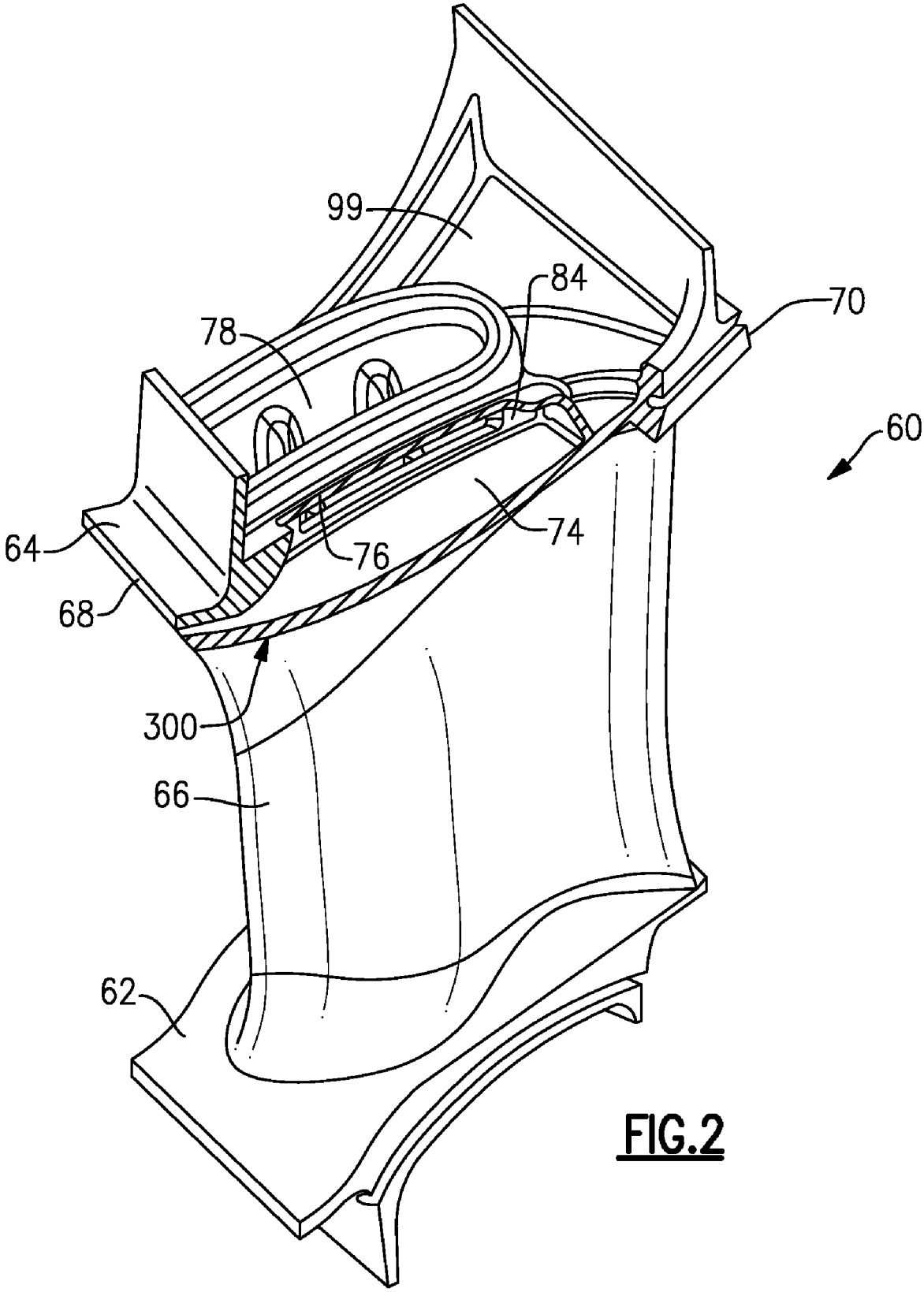
FIG. 2 shows a vane.

FIG. 2 shows a vane 60 which may be used at the location of FIG. 1 vanes 28, or elsewhere in turbine section 20. The vane 60 is particularly useful in the high pressure turbine section associated with rotor 22, although it may have application in the lower pressure section also. In fact, there is a vane which is not illustrated in FIG. 1 intermediate the rotor 22 and the combustion section 18, and the disclosed vane would be beneficial for that application.

Vane 60 includes opposed platform sections 62 and 64 which are mounted into structure at both radially inner and radially outer end of an airfoil 66. As known, the airfoil 66 serves to redirect the products of combustion between turbine rotor stages.

As shown in FIG. 2, the airfoil 66 is generally hollow, and cooling air passes through a passage 78 in platform 64 through passages within the airfoil section. There are other air passages, such as 99. As shown, a platform cooling passage 74 is connected to passage 78 by an orifice 76 in an internal wall 84 in order to supply cooling flow to passage 74 . Platform cooling passage 74 passes air forwardly toward the leading edge of the platform 68.

Figure 3A:
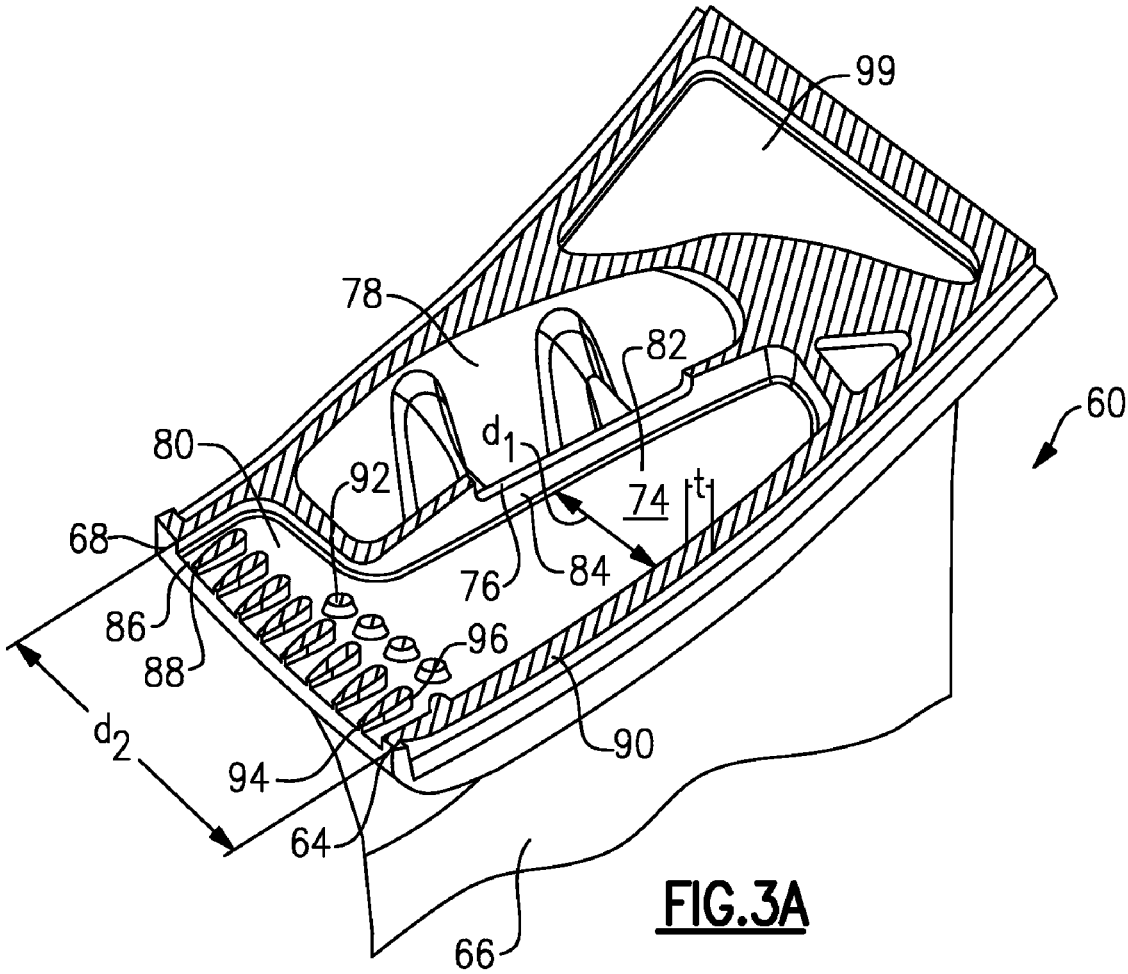
FIG. 3A is a cutaway through a platform in the FIG. 2 vane.

As shown in FIG. 3A, the platform cooling passage 74 supplies air along a circumferentially thin portion 82, toward the platform leading edge until it expands laterally outwardly into a section 80. Thin portion 82 is defined between an internal face of wall 90 and wall 84. Thus, at the leading edge the platform cooling section extends generally along the entire width of the platform, while at the thin portion 82, it is over a smaller portion of the width of the platform. The leading edge is provided with a plurality of teardrop shaped flow dividers 88. The teardrop shaped flow dividers define intermediate flow passages, or cooling slots, 86 at the platform leading edge 68. With the use of the teardrop shape flow dividers, pedestals 92 also can be utilized to enhance the backside convective cooling axially along the platform before the coolant is expelled through the platform leading edge slots 86. Additionally both the internal pedestal features 92 and the teardrop shape flow divider 88 flow passages can be tailored to re-distribute the circumferential coolant flow in order to address non uniformity in the freestream gas temperature profile.

Figure 3B:
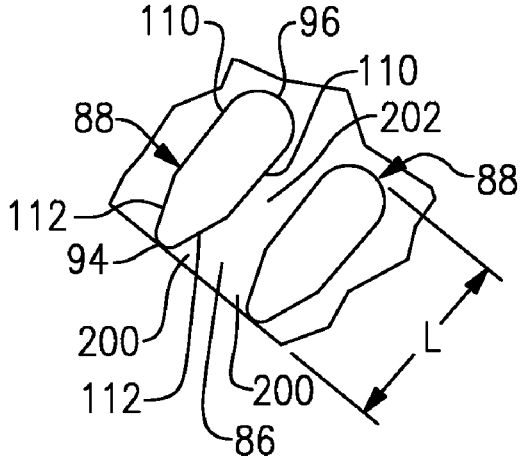
FIG. 3B is a teardrop shaped member forming cooling passages.

As can be appreciated from FIG. 3B, teardrop shaped flow dividers 88 have a curved portion 96 facing the trailing edge, generally parallel sidewalls 110 extending toward the platform leading edge, and angled portions 112 leading to a tip 94. In general, the end at tip 94 adjacent the platform leading edge is smaller than the end at curved portion 96 facing away from the platform leading edge.

With this shape, the flow passing to the leading edge is more effective in providing cooling. The use of the teardrop shaped flow dividers, creating slots 86 ensures that the air begins to diffuse as it exits 200 the platform passage, 74. As this air diffuses, and reaches the outer face of the platform leading edge, the products of combustion approaching the vane 60 at the platform leading edge, will drive the cooling air back along an outer skin of the vane, thus providing protective film cooling to the outer surface thereby reducing the net heat flux into the platform. In this manner, the platform passage 74 acts as a counter flow heat exchanger by providing both internal convective cooling within the vane platform, by first passing through passage 82, pedestals 92 and slots 86, and then after exiting slots 86 the coolant is reversed by the freestream air across the gas path side of the platform which provides protective film cooling along the outer vane platform surface 300 (FIG. 2).

The prior art use of teardrop shaped flow dividers at the trailing edge of the airfoil will not achieve this same effect, in that the product of combustion will pull the cooling air away from the vane. Still, the use of the teardrop shaped flow dividers at the platform leading edge in this application will have benefits along the entire boundary of the platform, and this application extends to any such location of the teardrop shaped flow dividers and their associated slots. While the specific disclosure is regarding teardrop shaped flow dividers, and the resultant slots, the invention is more broadly the use of slots which have a non-uniform cross-section such that the flow will diffuse as it leaves the platform.

Depending on the cooling necessary at the leading edge of any one vane application, various spacing, staggering, relative sizes across the teardrop shape components, etc., may be utilized. A worker of ordinary skill in this art, armed with this disclosure, would be able to appropriately design an array of teardrop shaped flow dividers.

As is known, the vane 60 is cast, and typically utilizing the lost core molding technique. A core is formed which will include spaces for each of the flow dividers 88, and is solid at the location of the passages 86. After metal is cast around that core, the core is leached away, leaving the vane 60 as shown in the figures. Thus, the flow dividers are cast, rather than having the openings formed by drilling as in the prior art.

While the vane is shown as having a single airfoil extending between the opposed platforms, this invention would also extend to the type of vanes having a plurality of airfoils connected to each platform.

Although an embodiment of this invention has been disclosed, a worker of ordinary skill in the art would recognize that certain modifications would come within the scope of this invention. For that reason, the following claims should be studied to determine the true scope and content of this invention.

We claim:

1. A vane for use in a gas turbine engine comprising:

a platform being connected to an airfoil, there being a cooling passage in said platform for supplying cooling air into said platform;

said platform having a leading edge and a trailing edge, a cooling chamber for supplying cooling air to said platform, and said platform being provided with a plurality of cooling slots, said cooling slots communicating with said cooling chamber, and said cooling slots having a non-uniform cross section;

said cooling slots being formed at the leading edge, and said cooling slots being larger at an end adjacent said leading edge then they are at an end spaced from said leading edge such that air leaving said cooling slots will diffuse.

2. The vane as set forth in claim 1, wherein there is a platform at each of two radial ends of said airfoil.

3. The vane as set forth in claim 1, wherein said cooling slots are formed by intermediate teardrop shaped flow dividers.

4. The vane as set forth in claim 3, wherein said teardrop shaped flow dividers have a curved end facing away from said leading edge, parallel sidewalls, and an outer end which is smaller in a width than is said curved end.

5. The vane as set forth in claim 3, wherein said cooling chamber being relatively thin in a width dimension at axially central locations of said vane, and extending for a greater portion of said width as said cooling chamber approaches said leading edge of said vane.

6. The vane as set forth in claim 3, wherein pedestals are positioned in said cooling chamber upstream, defined in a direction of cooling airflow through the platform of said teardrop shaped flow dividers.

7. The vane as set forth in claim 1, wherein said cooling passage is separated from said cooling chamber by an internal wall, and a hole in said internal wall is used to connect said cooling passages with said cooling chamber.

8. The vane as set forth in claim 1, wherein cooling air passing through the cooling slots exits the platform at the leading edge.

9. A vane for use in a gas turbine engine comprising:

a platform being connected to an airfoil, there being a cooling passage in said platform for supplying cooling air into said platform;

said platform having a leading edge and a trailing edge, a cooling chamber for supplying cooling air to said leading edge of said platform, and said leading edge being provided with a plurality of cooling slots, said cooling slots communicating with said cooling chamber;

said cooling slots formed by intermediate teardrop shaped flow dividers; and said teardrop shaped flow dividers having a curved end facing away from said leading edge, parallel sidewalls, and an outer end which is smaller in a width than is said curved end.

10. The vane as set forth in claim 9, wherein there is a platform at each of two radial ends of said airfoil.

11. The vane as set forth in claim 9, wherein pedestals are positioned in said cooling chamber upstream in a direction of cooling airflow of said teardrop shaped flow dividers.

12. The vane as set forth in claim 9, wherein said cooling chamber being relatively thin in a width dimension at axial central locations of said vane, and extending for a greater portion of said width as said cooling chamber approaches said leading edge of said vane.

13. The vane as set forth in claim 9, wherein said cooling passage is separated from said cooling chamber by an internal wall, and a hole in said internal wall is used to connect said cooling passages with said cooling chamber.

14. The vane as set forth in claim 9, wherein cooling air passing through the cooling slots exits the platform at the leading edge.

15. A vane for use in a gas turbine engine comprising:

a platform being connected to an airfoil, there being a cooling passage in said platform for supplying cooling air into said platform;

said platform having a leading edge and a trailing edge, a cooling chamber for supplying cooling air to said leading edge of said platform, and said leading edge being provided with a plurality of cooling slots, said cooling slots communicating with said cooling chamber;

said cooling slots formed by intermediate teardrop shaped flow dividers;

said teardrop shaped flow dividers having a curved end facing away from said leading edge, parallel sidewalls, and an outer end which is smaller in a width than is said curved end;

there being a platform at each of two radial ends of said airfoil, pedestals being positioned in said cooling chamber upstream of said teardrop shaped flow dividers in a direction of cooling airflow, said cooling chamber being relatively thin in a width dimension at axial central locations of said vane, and extending for a greater portion of said width as said cooling chamber approaches said leading edge of said vane; and said cooling passage being separated from said cooling chamber by an internal wall, and a hole in said internal wall is used to connect said cooling passages with said cooling chamber.

16. The vane as set forth in claim 15, wherein cooling air passing through the cooling slots exits the platform at the leading edge.

* * * * *